United States Patent [19]

Chiron et al.

[11] 4,152,677

[45] May 1, 1979

[54] WIDE BAND MICROWAVE ISOLATORS

[75] Inventors: Bernard Chiron; Gerard Forterre; Jean Marcoux, all of Paris, France

[73] Assignee: Societe Lignes Telegraphiques et Telephoniques, Paris, France

[21] Appl. No.: 928,273

[22] Filed: Jul. 26, 1978

Related U.S. Application Data

[63] Continuation of Ser. No. 774,547, Mar. 4, 1977, abandoned.

[30] Foreign Application Priority Data

Mar. 12, 1976 [FR] France ..... 76 06792

[51] Int. Cl.[2] ..... H01P 1/36

[52] U.S. Cl. ..... 333/24.2; 333/240

[58] Field of Search ..... 333/1.1, 24.1, 24.2, 333/98 M

[56] References Cited

U.S. PATENT DOCUMENTS

| | | | |
|---|---|---|---|
| 3,845,413 | 10/1974 | Chiron et al. | 333/24.2 X |
| 3,886,502 | 5/1975 | Radding et al. | 333/24.2 |
| 3,928,806 | 12/1975 | Carter et al. | 333/24.2 X |

*Primary Examiner*—Paul L. Gensler

*Attorney, Agent, or Firm*—Kemon & Estabrook

[57] ABSTRACT

In a surface wave isolator consisting of two gyromagnetic slabs a conductive strip between said slabs, means to establish a magnetizing field within said slabs, a two part load is associated side by side with said slabs and the strip extends also between the two parts of the load. A first part of the load is a continuous load parallel to the strip, a second part of the load is a plurality of localized absorbing means placed along the propagation axis and parallel to said strip. The impedance of the localized absorbing means is matched to the impedance of an unwanted parasitic propagation mode at the corresponding place.

8 Claims, 4 Drawing Figures

WIDE BAND MICROWAVE ISOLATORS

This is a continuation, of application Ser. No. 774,547, filed Mar. 4, 1977 now abandoned.

BACKGROUND OF THE INVENTION

The present invention concerns isolators utilizing the propagation of non-reciprocal surface electromagnetic waves in a gyromagnetic medium. Such devices have already formed the subject of publications; there will be mentioned inter alia U.S. Pat. No. 3,845,413 filed on the 23rd Oct., 1973 and assigned to the same Assignor. Articles have been published in Cables et Transmissions (France), October 1973, pages 416 to 435, and in Transactions on Magnetics of the Institute of Electrical and Electronic Engineers (United States) - Vol Mag 11 - No. 5 - September 1975, page 1276.

The articles bear more particularly on the analysis of the surface non-reciprocal propagation modes and of the parasitic modes (reciprocal volume or surface propagation modes), which can be excited at frequencies within the band to be transmitted and are propagated in the gyromagnetic material simultaneously with the desired non-reciprocal surface mode. The parasitic modes which are closest to the operating mode (which is termed the "dynamic mode" in the cited articles) are volume modes. The present invention relates essentially to means for reducing the proportion of the input energy which is converted into a parasitic wave, which energy is taken from that which is propagated in the dynamic mode. In other words, the invention has for its object to reduce the insertion losses of the devices and at the same time the standing wave ratio which they introduce into the equipment in which they are fitted while approaching as closely as possible to a monomode propagation. The invention also relates to means for selectively attenuating the parasitic waves so as to reduce the transmitted parasitic energy, which results in a reduction of the amplitude variations in the bandwidth and provides an increase of the bandwidth at a preset insertion loss, or a reduction of the insertion loss at a preset bandwidth.

BRIEF DISCLOSURE OF THE INVENTION

The present invention is essentially characterized by the provision of the load incorporated in the propagation medium and comprising a first part which is uniformly distributed along the path of the waves and a second part which consists of a set of loads located at the points where the impedance of the load is matched to that of the mode to be suppressed. In accordance with a subsidiary feature of the invention, the gyromagnetic material operating as the wave propagating medium has faces which have been given an optical polish at least in planes parallel to the strip. The polishing of these faces is intended to reduce the excitation of the parasitic surface waves (reciprocal modes), which ensures a widening of the bandwidth by elimination of the resonance peaks of these parasitic modes. It also renders possible a reduction of the length of the path in the gyromagnetic material for a given attenuation, whereby the insertion loss is reduced. A 25% reduction in length has been obtained in a particular construction with a reduction of the insertion loss.

The isolators according to the present invention may also be operated at maximum frequencies which are higher than those usually reached for a given insertion loss. By way of example, an isolator covering the band 3–18 GHz with an insertion loss of 1.8 dB at 18 GHz has been produced.

BRIEF DESCRIPTION OF THE DRAWINGS

The invention will be readily understood from the following description and by reference to the accompanying figures, which are given by way of non-limiting example and in which.

DETAILED DESCRIPTION OF THE DISCLOSURE

Figure 1:
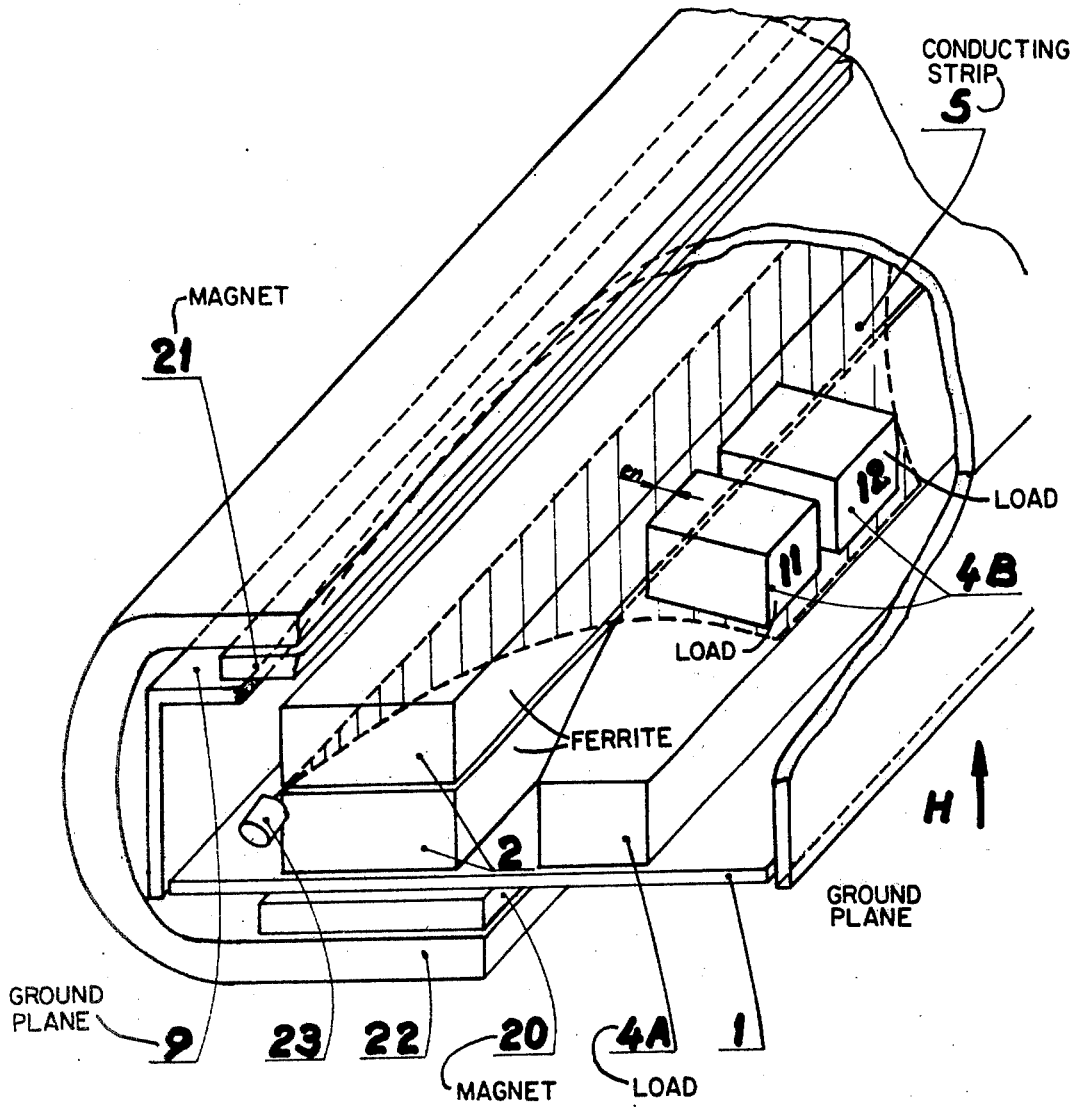
FIG. 1 is a view of the component parts of an isolator according to the invention, FIGS. 2 and 3 correspond to an isolator covering two octaves.
Figure 2:
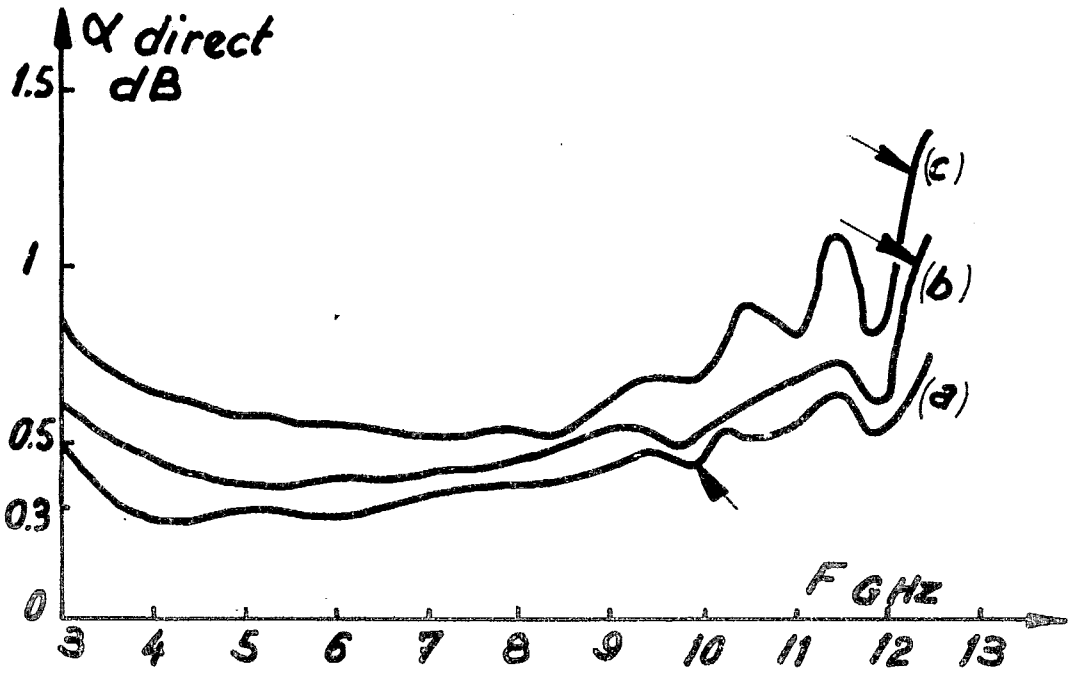

FIG. 1 is a diagrammatic illustration of a surface wave isolator according to the invention, in which the same references are employed as in FIGS. 1 and 2 of the aforesaid U.S. Pat. No. 3,845,413. There is shown at 1 one of the ground planes the second ground plane 9 being one of the faces of the casing (broken away for a readier understanding of the drawing). The propagation medium consists of the two ferrite slabs 2 and the loads 4A and 4B, between which the conducting strip 5 is situated; the large faces of the slabs 2 parallel to the direction of propagation have a surface state corresponding to optical polish; the ends of the load 4A and of the conducting strip 5 are so profiled as to effect the excitation of the dynamic TE mode as defined in the aforesaid articles when a wave propagated in the TEM mode is applied to the input of the device.

The present invention concerns a structure whose propagation medium incorporates no dielectric material, as illustrated in FIG. 1 of the aforesaid patent. The present invention concerns essentially the form of the load 4A–4B disposed along the slabs 2 as described in said United States Patent. In accordance with the essential feature of the present invention, the load is made in two parts 4A and 4B respectively. 4A is a continuous load extending over the whole length of the structure below the conducting strip 5. At the two ends, the load 4A is terminated by faces inclined in relation to the direction of propagation. The load 4B consists of two bars 11 and 12 disposed on the conducting strip 5. It is to be understood that this number has no limiting character and has been selected small for a readier understanding of the drawing. The distance between the terminal face closer to the upper slab 2 and the bar, denoted by $e_n$, is experimentally adjusted for each bar, the position corresponding to the best performance of the device being experimentally determined such as by the means of an oscilloscope display of the output in the bandwidth. Theoretically, the distance $e_n$ could be defined as that which ensures matching between the impedance of the bar 11 and that of the parasitic wave to be eliminated at that point of the axis of propagation which is under consideration. In some constructions, it has been observed that better results are obtained by inclining the longitudinal axis of the bar at an angle different from 90° in relation to the direction of propagation. In the GHz range, the distances $e_n$ are of the order of the millimeter. The number of bars such as 11, 12, and therefore their spacing, depends upon the width of the frequency band to be transmitted; these two values vary in the same sense, as will be seen from the examples given in the following. The distance between two consecutive bars depends notably upon the number of bars required for obtaining the desired characteristic. The dimensions of the slabs 2 of gyromagnetic material are fixed with reference to the curves resulting from the theoretical study published in the aforesaid two references. The structure is completed by two magnets 20 and 21 which are interconnected by a magnetic circuit 22 in order to establish in the volume occupied by the gyromagnetic material a uniform field which is directed as shown at H in the figure. The two ground planes are connected by side metallic faces which close the casing in which the device is enclosed. Only one of the connecting plugs is diagrammatically indicated at 23, it being understood that it is fixed in the front face of the casing (not shown in the figure).

Figure 3:
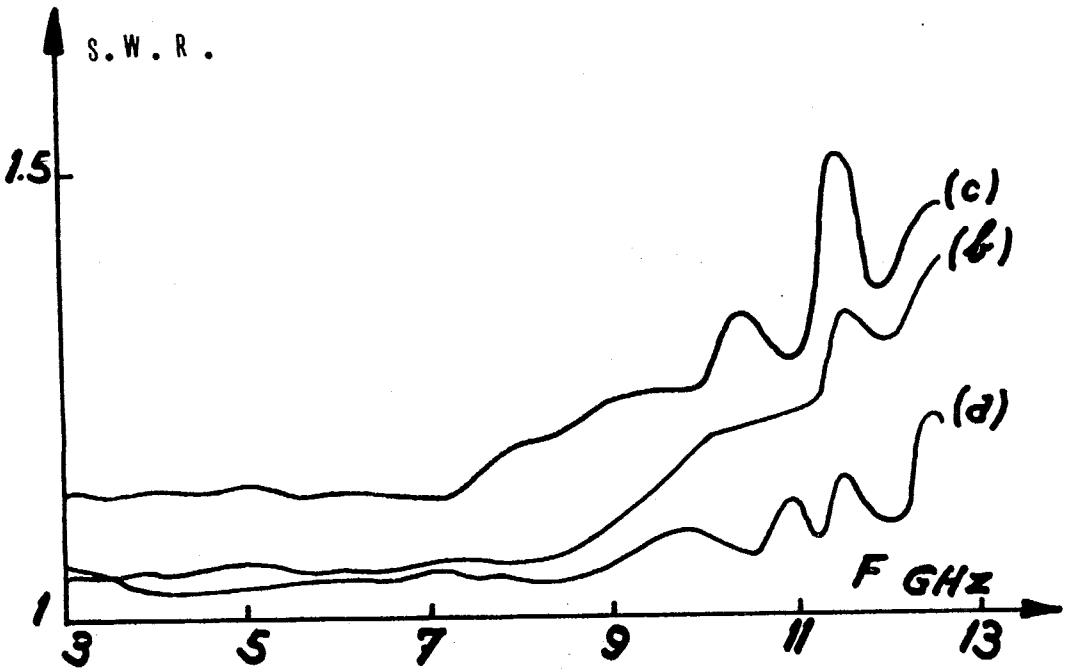

FIGS. 2 and 3 illustrate respectively the insertion loss and standing wave ratio characteristics of a construction according to the invention designed with a view to minimising the said losses. The curves a, b, c correspond to different surface states of the slabs 2 of gyromagnetic material and clearly show the improvement afforded by the polishing. Curve c corresponds to slabs having scratches visible to the eye, the curves b to slabs as ground and the curves a to slabs whose faces have been optically polished. The design of the isolator corresponds to that illustrated in FIG. 1. The number of bars in 4B is 2. The bars have the following dimensions (length×width×thickness) $7\times8\times1.4$ mm$^3$. The load 4A has the dimensions $28\times8\times1.4$ mm$^3$ and the slabs 2 each have the following dimensions: (length×width×thickness) $48\times10.5\times1.4$ mm$^3$. It will be seen that between 3 and 12 GHz the maximum insertion loss is 0.65 dB and that it remains below 0.5 dB between 3 and 10 GHz. In the same bands, the maximum s.w.r. is 1.1 and lower than 1.2 respectively.

Figure 4:
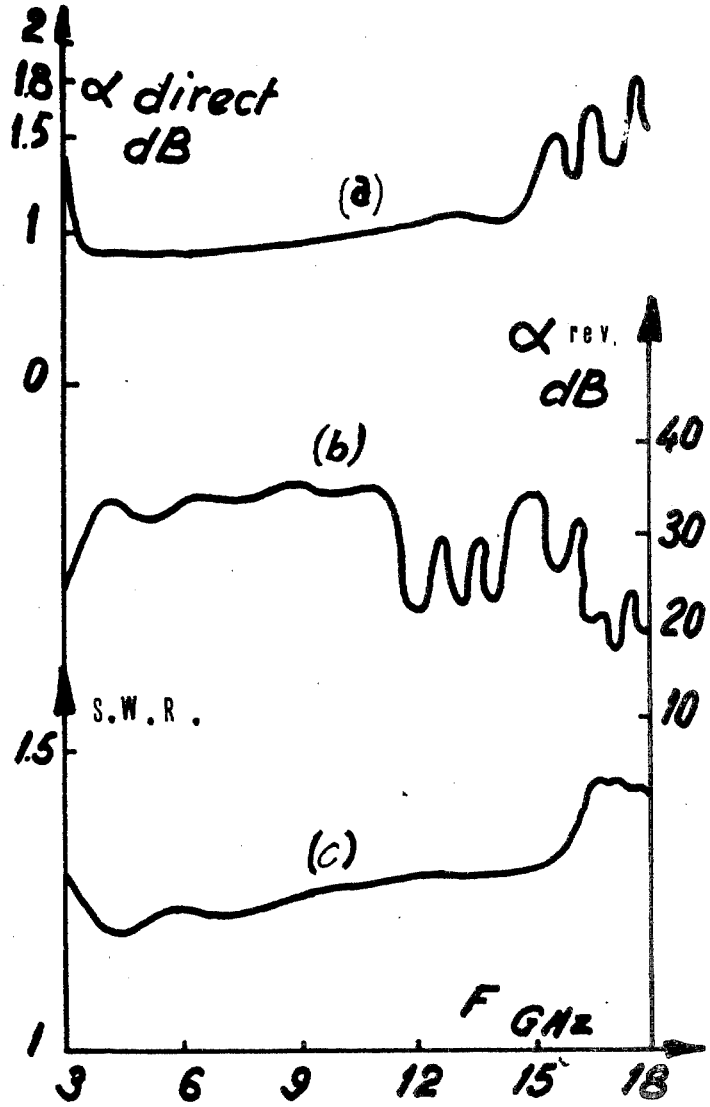
FIG. 4 illustrates the characteristics of an isolator covering 2.5 octaves.

FIG. 4 shows in combination the insertion loss, isolation and standing wave ratio characteristics of an isolator according to the invention designed with a view to obtaining a maximum useful frequency band (3 to 18 GHz). It will be seen that in the band the insertion loss (curve a, axis of ordinates to the left) remains below 2 dB despite a rapid increase at the higher frequencies of the band, the isolation (curve b, axis of ordinates to the right) remains higher than 17 dB and the standing wave ratio (curve c, axis of ordinates to the left) remains below 1.45. This isolator was constructed with slabs 2 having the following dimensions (length×width×thickness) $48\times8.9\times1.2$ mm$^3$. The load 4A has a cross-section in the form of a trapezium cut out of a rectangle having the dimensions $35\times10$ mm$^2$ and a thickness of 1.2 mm. The small base of the trapezium has a length of 5 mm. The load 4B consists of four bars measuring $5\times10\times1.2$ mm$^3$. The loads consist of iron powder. The gyromagnetic material of the slabs 2 is an yttrium-iron garnet.

What we claim:

1. An elongate wide band microwave device utilizing non-reciprocal surface modes propagating in a direct direction along the long dimension of the device comprising:

an all magnetic direct propagation medium including: a conducting strip for effecting at its opposite ends the conversion of the TEM propagation mode into the non-reciprocal TE surface propagation mode and vice-versa; two gyromagnetic slabs parallel to and located on opposite sides of said strip so as to propagate the TE surface mode energy in the direct direction;

two absorbent loads respectively disposed in the planes of and alongside each slab on each side of said strip, a first load being made of a unitary slab extending along the whole long dimension of the device for damping the surface wave propagating in the reverse direction, and the second load comprising a plurality of smaller bars placed side by side along the long dimension for damping unwanted propagation modes compatible with slabs and strip dimensions; means affording electrical connection to opposite ends of said strip; two ground planes, positioned on opposite sides of said propagation medium respectively; and means for establishing a magnetic field through said medium in a plane perpendicular to said strip.

2. Device according to claim 1, wherein the faces of the two slabs of gyromagnetic material which are parallel to the plane of the strip have been optically polished.

3. Device according to claim 1, characterized in that the said slabs of gyromagnetic material are identical and the two loads are different: said load having a substantially trapezoidal section in a plane parallel to the strip and having its small base in contact with a first slab of gyromagnetic material, and said second load consisting of bars disposed parallel to the first load along the direction of propagation opposite the second gyromagnetic slab.

4. Device according to claim 3, wherein the distance between one end of the bars constituting the second load which is closer to the second gyromagnetic slab and the latter is so adjusted as to effect an impedance matching between the impedance of the said bar and that of the parasitic wave at that point on the axis of propagation which is under consideration.

5. Device according to claim 3, wherein the distance between two consecutive bars of the second load is so adjusted as to effect a matching between the impedance of the said bars and that of the parasitic waves at these points on the axis of propagation which are under consideration.

6. Device according to claim 3, wherein the bars constituting the second load have a facet which is inclined in relation to the lateral face of the second gyromagnetic slab.

7. Device according to claim 3, wherein the number of bars constituting the second load is an increasing function of the pass band.

8. Device according to claim 3, wherein the faces of the two slabs of gyromagnetic material which are parallel to the plane of the conductor have a surface finish which corresponds to an optical polish.

* * * * *